US005523826A

United States Patent [19]

Jugle

[11] Patent Number: 5,523,826

[45] Date of Patent: Jun. 4, 1996

[54] DEVELOPER UNITS WITH RESIDUAL TONER REMOVAL TO ASSIST RELOADING

[75] Inventor: Kip L. Jugle, Holcomb, N.Y.

[73] Assignee: Xerox Corporation, Stamford, Conn.

[21] Appl. No.: 374,319

[22] Filed: Jan. 18, 1995

[51] Int. Cl.[6] ..... G03G 15/06

[52] U.S. Cl. ..... 355/259; 355/215; 355/247

[58] Field of Search ..... 355/215, 260, 355/245, 247, 248, 249, 259; 118/647, 651

[56] References Cited

U.S. PATENT DOCUMENTS

| | | | |
|---|---|---|---|
| 3,965,862 | 6/1976 | Yang et al. | 118/651 |
| 3,980,541 | 9/1976 | Aine | 204/186 |
| 3,996,892 | 12/1976 | Parker et al. | 118/658 |
| 4,868,600 | 9/1989 | Hays et al. | 355/259 |
| 5,053,824 | 10/1991 | Schram | 355/259 |
| 5,144,370 | 9/1992 | Bares | 355/247 |
| 5,172,170 | 12/1992 | Hays et al. | 355/259 |
| 5,268,259 | 12/1993 | Sypula | 430/311 |
| 5,276,488 | 1/1994 | Schmidlin | 355/247 |
| 5,289,240 | 2/1994 | Wayman | 355/259 |
| 5,337,124 | 8/1994 | Schmidlin et al. | 355/259 |

*Primary Examiner*—Sandra L. Brase
*Attorney, Agent, or Firm*—John S. Wagley

[57] ABSTRACT

A developer unit for developing a latent image recorded on an image receiving member to form a developed image is provided. The developer unit includes a housing defining a chamber for storing at least a supply of toner therein and a moving donor member spaced from the image receiving member. The donor member is adapted to transport toner from the chamber of the housing to the image receiving member in a development zone. The donor member receives toner from a reloading zone. The developer unit also includes an electrode structure and an electrical field establisher for establishing an electrical field between the donor member and the electrode structure. The electrical field establisher is spaced from the development zone and the reloading zone, to assist in cleaning toner from the donor member.

8 Claims, 3 Drawing Sheets

DEVELOPER UNITS WITH RESIDUAL TONER REMOVAL TO ASSIST RELOADING

The present invention relates to a developer apparatus for electrophotographic printing. More specifically, the invention relates to a donor roll as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al. U.S. Pat. No. 4,868,600 to Hays et al., which is hereby incorporated by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to replace the externally located electrode wires with electrodes integral to the donor roll.

In U.S. Pat. No. 5,172,170 to Hays et al., there is disclosed an apparatus for developing a latent image recorded on a surface, including a housing defining a chamber storing at least a supply of toner therein a moving donor member spaced from the surface and adapted to transport toner from the chamber of said housing to a development zone adjacent the surface, and an electrode member integral with the donor member and adapted to move therewith. The electrode member is electrically biased to detach toner from said donor member to form a cloud of toner in the space between the electrode member and the surface with toner developing the latent image.

The biasing of the electrodes is typically accomplished by using a conductive brush which is placed in a stationary position in contact with the electrodes on the periphery of the donor member. U.S. Pat. No. 5,172,170 is herein incorporated by reference. The conductive brush is electrically connected with a electrically biasing source. At least one, but typically four of the electrodes in the nip between the donor member and the developing surface are electrically biased. As the donor member rotates the electrodes that now are in the nip need to contact the brush.

After the periphery of the donor member passes the nip, the toner used to develop the latent image is no longer on the donor roll periphery. The toner remaining on the donor roll periphery is generally a mirror image of the developed image. The donor roll periphery includes a reload area where the toner was consumed to form the developed image and a background area.

In the reload area, the nip between the donor roll and the transport roll, toner is separated from carrier granules and transferred to the periphery of the donor roll. Most of the toner transfer occurs in reload area of the periphery of the donor roll.

When using scavangeless development, only a portion of the toner removed in the reload area is reloaded onto the donor roll. This is because the reload area behaves differently from the background area. In wire type scavangeless development systems the reload percentage is about 70%, while with segmented electroded donor roll type scavangeless development systems the reload percentage is about 50%.

The only partial reloading of the reload areas of the donor roll result two major problems that negatively affect copy quality. These problems are called lighted reload and darkened reload. Compensation for these problems is difficult as relieving one problem compounds the other.

Lighted reload refers to those situations where the solid areas or areas to be developed have areas that are too light. This problem can occur from either of two causes. The first cause is simply not enough mass on the donor roll to satisfy the demands of the area to be developed. The second cause is due to the fact that the voltage across the toner in the reload area is less than the voltage in the background area. The voltage across the toner and the voltage on the developing surface define the development potential. The lower development potential in the reload area results in less toner on the latent image and thus a lighter image.

Darkened reload refers to those situations where the solid areas or areas to be developed have areas that are too dark. While this phenomenon is not fully understood, it is believed that darkened reload occurs because the toner particles in the reload area are lower in charge and larger in size than particles in the background area. The tribo or charge to mass ratio in the reload area is decreased due to the larger mass of the particles. The larger particles and decreased tribo serve to overcompensate for the less voltage in the reload area causing excess toner to be transferred to the reload area of the surface.

The following disclosures related to scavangeless development and electroded rolls may be relevant to various aspects of the present invention:

U.S. Pat. No. 5,289,240

Patentee: Wayman issue Date: Feb. 22, 1994

U.S. Pat. No. 5,268,259

Patentee: Sypula

Issue Date: Dec. 7, 1993

U.S. Pat. No. 5,172,170

Patentee: Hays et al.

Issue Date: Dec. 15, 1992

U.S. Pat. No. 4,868,600

Patentee: Hays et al.

Issue Date: Sep. 19, 1989

U.S. Pat. No. 3,996,892

Patentee: Parker et al.

Issue Date: Dec. 14, 1976

U.S. Pat. No. 3,980,541

Patentee: Aine

Issue Date: Sep. 14, 1976

U.S. Pat. No. 5,289,240 discloses a donor roll which has two distinct set of electrodes along the periphery of the donor roll. The roll has a first set of electrodes that extend axially the length of the roll, are interconnected to each other and contact the filaments of a brush. The roll also has a second set of electrodes that extend axially the length of the roll, are interconnected to each other and do not contact the brush.

U.S. Pat. No. 5,268,259 discloses a process for preparing a toner donor roll which has an integral electrode pattern. The process includes coating a cylindrical insulating member with a photoresistive surface, pattern exposing the photoresistive surface to light to form an electrode pattern and depositing conductive metal on the portion of the member exposed to light to form the electrode pattern.

U.S. Pat. No. 5,172,170 discloses a donor roll with a plurality of electrical conductors spaced from one another with one of the conductors located in one of the grooves in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 3,996,892 discloses a donor roll having an electrically insulative core made of a phenloic resin. The donor roll core is coated with conductive rubber doped with carbon black. Conductor strips are formed on the rubber by a copper cladding process followed by a photo-resist-type etching technique.

U.S. Pat. No. 3,980,541 discloses composite electrode structures including mutually opposed electrodes spaced apart to define a fluid treatment region. Resistive electrodes serve to localize the effects of electrical shorts between electrodes. Non-uniform sheet and filamentary electrodes are disclosed for producing a substantially non uniform electric field.

SUMMARY OF THE INVENTION

According to the present invention, there is provided a developer unit for developing a latent image recorded on an image receiving member to form a developed image. The developer unit includes a housing defining a chamber for storing at least a supply of toner therein and a moving donor member spaced from the image receiving member. The donor member is adapted to transport toner from the chamber of the housing to the image receiving member in a development zone. The donor member receives toner from a reloading zone. The developer unit also includes an electrode structure and an electrical field establisher for establishing an electrical field between the donor member and the electrode structure. The electrical field establisher is spaced from the development zone and the reloading zone, to assist in cleaning toner from the donor member.

According to the present invention, there is also provided an electrophotographic printing machine of the type having a developer unit adapted to develop with marking particles an electrostatic latent image recorded on a photoconductive member. The developer unit includes a housing defining a chamber for storing at least a supply of toner therein and a moving donor member spaced from the image receiving member. The donor member is adapted to transport toner from the chamber of the housing to the image receiving member in a development zone. The donor member receives toner from a reloading zone. The developer unit also includes an electrode structure and an electrical field establisher for establishing an electrical field between the donor member and the electrode structure. The electrical field establisher is spaced from the development zone and the reloading zone, to assist in cleaning toner from the donor member.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
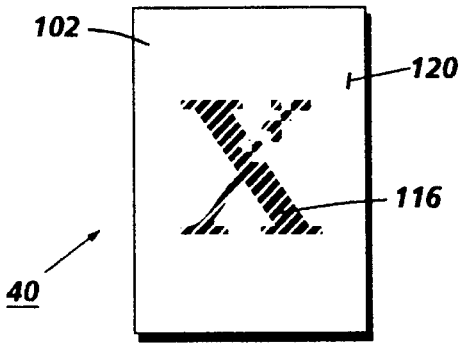
FIG. 3 is a schematic elevational view of an illustrative printing machine incorporating the load assisting toner excitation of the present invention.

Referring initially to FIG. 3, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, ROS 36 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 3. At development station C, a development system 38, develops the latent image recorded on the photoconductive surface. Preferably, development system 38 includes a donor roll or roller 40 and electrode wires 42 positioned in the periphery of the donor roll 40. Electrodes 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material 45. The developer material is a two component developer material of at least magnetic carrier granules having toner particles adhering triboelectrically thereto. A transport roll or roller 46 disposed interiorly of the chamber of housing 44 conveys the developer material to the donor roll 40. The transport roll 46 is electrically biased relative to the donor roll 40 so that the toner particles are attracted from the transport roller to the donor roller.

Again referring to FIG. 3, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
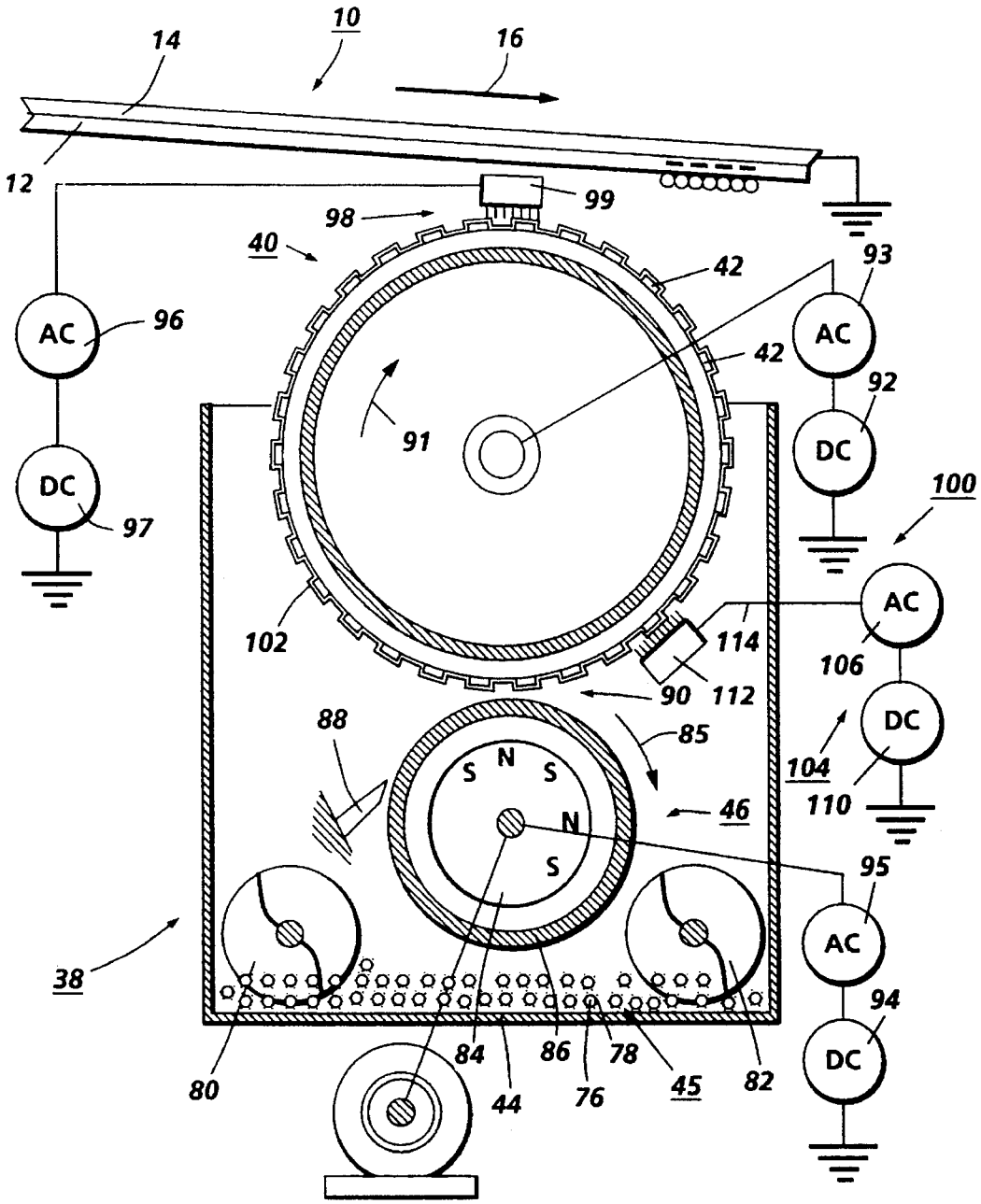
FIG. 1 is a schematic elevational view of a development unit incorporating the load assisting toner excitation of the present invention.

Referring now to FIG. 1, there is shown development system 38 in greater detail. Housing 44 defines the chamber for storing the supply of developer material 45 therein. The developer material 45 includes carrier granules 76 having toner particles 78 adhering triboelectrically thereto. Positioned in the bottom of housing 44 are horizontal augers 80 and 82 which distribute the developer material 45 uniformly along the length of the transport roll 46 in the chamber of housing 44.

Transport roll 46 includes a stationary multi-pole magnet 84 having a closely spaced sleeve 86 of non-magnetic material, preferably aluminum, designed to be rotated about the magnet 84 in a direction indicated by arrow 85. Because the developer material 45 includes the magnetic carrier granules 76, the effect of the sleeve 86 rotating through stationary magnetic fields is to cause developer material 45 to be attracted to the exterior of the sleeve 86. A doctor blade 88 meters the quantity of developer adhering to sleeve 86 as it rotates to a loading zone 90, the nip between transport roll 46 and donor roll 40.

The donor roll 40 is kept at a specific voltage, by a direct current, DC. voltage source 92 to attract a layer of toner particles 78 from transport roll 46 to donor roll 40 in the loading zone 90.

An alternating current, AC, voltage source 93 may also be connected to the donor roll 40. The effect of the AC electrical field applied along the donor roller in loading zone 90 is to loosen the toner particles 78 from their adhesive and triboelectric bonds to the carrier granules 76. Either the whole of the donor roll 40, or at least a peripheral layer thereof, is preferably of material which has low electrical conductivity. The material must be sufficiently conductive to prevent any build-up of electric charge with time, and yet its conductivity must be sufficiently low to form a blocking layer to prevent shorting or arcing of the magnetic brush to the donor roll.

Transport roll 46 is biased by both a DC voltage source 94 and an AC voltage source 95. The effect of the DC electrical field is to enhance the attraction of the developer material 45 to sleeve 86. It is believed that the effect of the AC electrical field applied along the transport roller in loading zone 90 is to loosen the toner particles from their adhesive and triboelectric bonds to the carrier granules.

While the development system 38 as shown in FIG. 1 utilizes donor roller DC voltage source 92 and AC voltage source 93 as well as transport roller DC voltage source 94 and AC voltage source 95, the invention may be practiced, with merely DC voltage source 92 on the donor roll.

It has been found that a value of up to 200 $V_{rms}$ is sufficient for the output of transport roll AC voltage source 95 for the desired level of reload efficiency of toner particles to be achieved. The actual value can be adjusted empirically. In theory, the value can be any value to a maximum voltage of about 400 $V_{rms}$. The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

The donor roll 40 preferably includes the electrodes 42 in the form of electrical conductors positioned about the peripheral circumferential surface thereof. The electrical conductors 42 are substantially spaced from one another and insulated from the body of donor roll 40 which may be electrically conductive. Donor roll 40 rotates in the direction of arrow 91. The relative voltages between donor roll 40 and transport roll 46 are selected to provide efficient loading of toner on donor roll 40 from the carrier granules adhering to transport roll 46. Furthermore, reloading of developer material on transport roll 46 is also enhanced. In the development zone, AC and DC electrode voltage sources 96 and 97, respectively, electrically bias electrical conductors 42 to a DC voltage having an AC voltage superimposed thereon.

Electrode voltage sources 96 and 97 are in wiping contact with isolated electrodes 42. As donor roll 40 rotates in the direction of arrow 91, successive electrodes 42 advance into development zone 98, the nip between the donor roll 40 and the photoreceptor belt 10, and are electrically biased by the voltage sources 96 and 97.

As shown in FIG. 1, a wiping brush 99 contacts isolated electrodes 42 in the development zone 98 and is electrically connected to electrode voltage sources 96 and 97. In this way, isolated electrodes or electrical conductors 42 advance into development zone 98 as donor roll 40 rotates in the direction of arrow 91. Isolated electrodes, i.e. electrical conductors 42, in development zone 98, contact wiping brush 99 and are electrically biased by electrode voltage sources 96 and 97. In this way, an AC voltage difference is applied between the isolated electrical conductors and the donor roll detaching toner from the donor roll and forming a toner powder cloud.

According to the present invention and referring again to FIG. 1, a toner remover preferably in the form of a toner removing exciter 100 is shown. The toner remover 100 is located near periphery 102 of the donor roll 40 between the development zone 98 and the loading zone 90. The toner remover 100 may take any suitable form whereby the toner remover 100 removes the toner particles 78 from the periphery 102 of the donor roll 40. The toner remover 100 may thus be a mechanical toner remover or a toner removing exciter that imparts an electrical or electrostatic charge upon the surface 102 of the donor roll 40 in order to remove the toner particles 78 from the periphery 102 of the donor roll 40.

If the toner remover 100 is in the form of a mechanical remover, the toner remover 100 may be in the form of a brush (not shown), a blade (not shown), a vacuum source and nozzle (not shown) or any other mechanical device suitable to remove toner from a toner carrying surface.

Preferably, the toner removal 100 is in the form of an electrically biasing toner removing exciter device. For example, the toner removing exciter 100 may include a power source 104. The power source 104 may include an AC power source 106 as well as a DC power source 110. It should be appreciated, however, that either the AC power source 106 or the DC power source 110 may be sufficient to provide the excitation of the toner necessary to remove the toner particles 78 from the periphery 102 of the donor roll 40. The power source 104 is electrically connected to the electrodes 42 embedded along the periphery 102 of the donor roll 40. The power source 104 may be electrically connected to the electrodes 42 in any suitable fashion, but preferably the electrodes 42 are electrically connected to the power source 104 through a brush 112. Preferably, the brush 112 is of similar shape and construction as the brush 99. The brush 112 may be located anywhere between the development zone 98 and the loading zone 90, that is, anywhere downstream of the brush 99 in the direction of rotation of the arrow 91. An electrical conduit 114 interconnects the brush 112 to the power source 104.

Care should be taken to position the brush 112 in a position that is deep enough into the housing 44 to permit the toner 78 to return into the housing 44 and yet far enough from the loading zone 90 to prevent the power source 104 from removing toner 78 as it is reloaded on the donor roll 40. The toner remover 100 does not need to remove 100 percent of the toner on the periphery 102 of the donor roll 40, but merely remove a significant portion of that toner 78.

First, toner 78 on the periphery 102 of the donor roll 40 approaches first the development nip 98 adjacent the brush 99 and is excited to form a powder cloud and to develop the latent image upon the surface 12 of the photoreceptor belt 10. Excess toner particles 78 pass along the periphery 102 of the donor roll 40 as it rotates in the direction of arrow 91 to an area near the brush 112. The power source 104 sends a charge to the brush 112. The brush 112 contacts the electrodes 42 to form a powder cloud around the loading zone 90 to remove the toner particles 78 from the donor roll 40. The portion of the periphery 102 of the donor roll 40 which is now substantially clean of the toner particles 78 advances to the loading zone 90. Fresh developer material 45 including the toner particles 78 triboelectrically attached to carrier beads 76, are simultaneously advanced by the transport roll 46 to the loading zone 90. In the loading zone 90, the toner particles 78 are attracted by the AC and DC charge 93 and 92 to the periphery 102 of the donor roll 40 thereby reloading the donor roll 40 to provide toner particles 78 for the next latent image.

Figure 4:
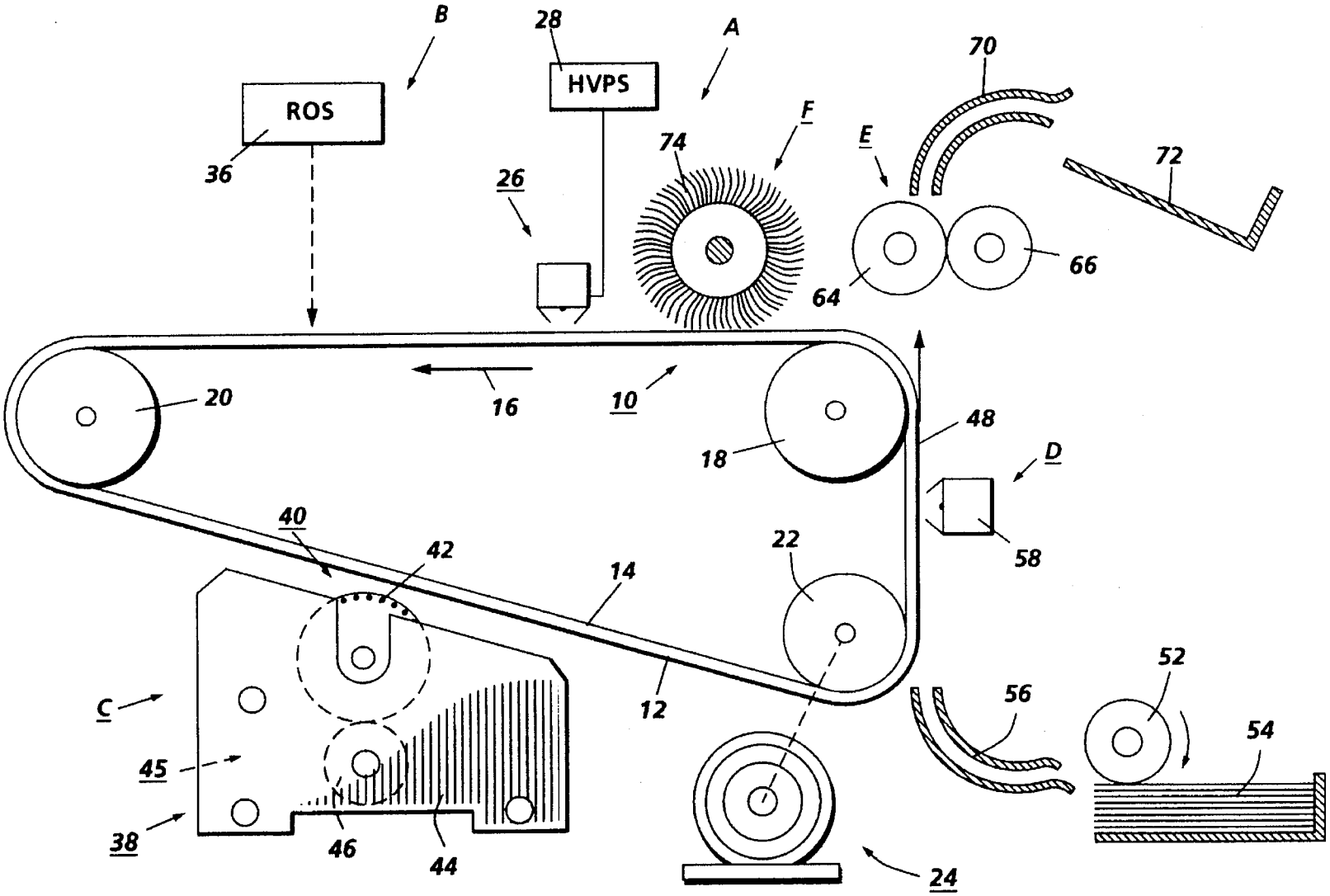
FIG. 4 is a partial plan view of the donor roll of the development unit of FIG. 1.

The periphery 102 of the donor roll 40 is shown in greater detail in FIG. 4. The periphery 102 includes two areas, a reload area 116 and a background area 120. The background area corresponds to that part of the developed image which includes the non-image or white area. The reload area 116 includes that portion of the developed image in which the imaging occurs, i.e. where the area is black. As the donor roll 40 progresses from the development zone 98 to the reload zone 90 (see FIG. 1), more toner must be replenished in the reload area 116 of the donor roll than in the background area 120 of the donor roll. Further compounding this problem, the background area 120 and the reload area 116 behave differently. Typically, the reload area does not attract as much toner when reloading in the reload area than the background area 120. Typically, the reload percentage or segmented electrode donor type scavengeless development systems is about 50 percent. The reload percentage is the density in the reload area divided by the density in the background area times 100%.

The only partial reloading of the reload area of the donor roll results in two major problem that negatively affect copy quality. These problems are called lightened reload and darkened reload. Compensation for these problems is difficult as relieving one problem compounds the other.

Lightened reload refers to those situations where the solid areas or areas to be developed have areas that are too light. This problem can occur either from not enough mass on the donor roll to satisfy the demands of the area to be developed or from an insufficient voltage across the toner in the reload areas. Either of these causes result in less toner on the latent image and thus a lighter image.

Darkened reloads refer to those situations where the solid areas or areas to be developed are too dark. Darkened reload occurs because the toner particles in the reload area are lower in charge and larger in size than particles in the background area. The larger particles and decreased tribo serve to overcompensate for the lower voltage in the reload area causing excess toner to be transferred to the reload area.

By having the brush 112 (see FIG. 1) exert an electrostatic field on the periphery 102 of the donor roll, the extra toner in the background area 120 is removed so that the amount of toner in the reload area 116 and the background area 120 are more similar. Since the toner concentration in the background area 120 and the reload area 116 are now similar, the background area 120 and the reload area 116 are replenished with toner 78 in the reload zone 90 similarly.

Since the background areas 120 and the reload areas 116 behave similarly, the heretofore problems with darkened and lightened reloads are hereby reduced or eliminated.

Figure 2:
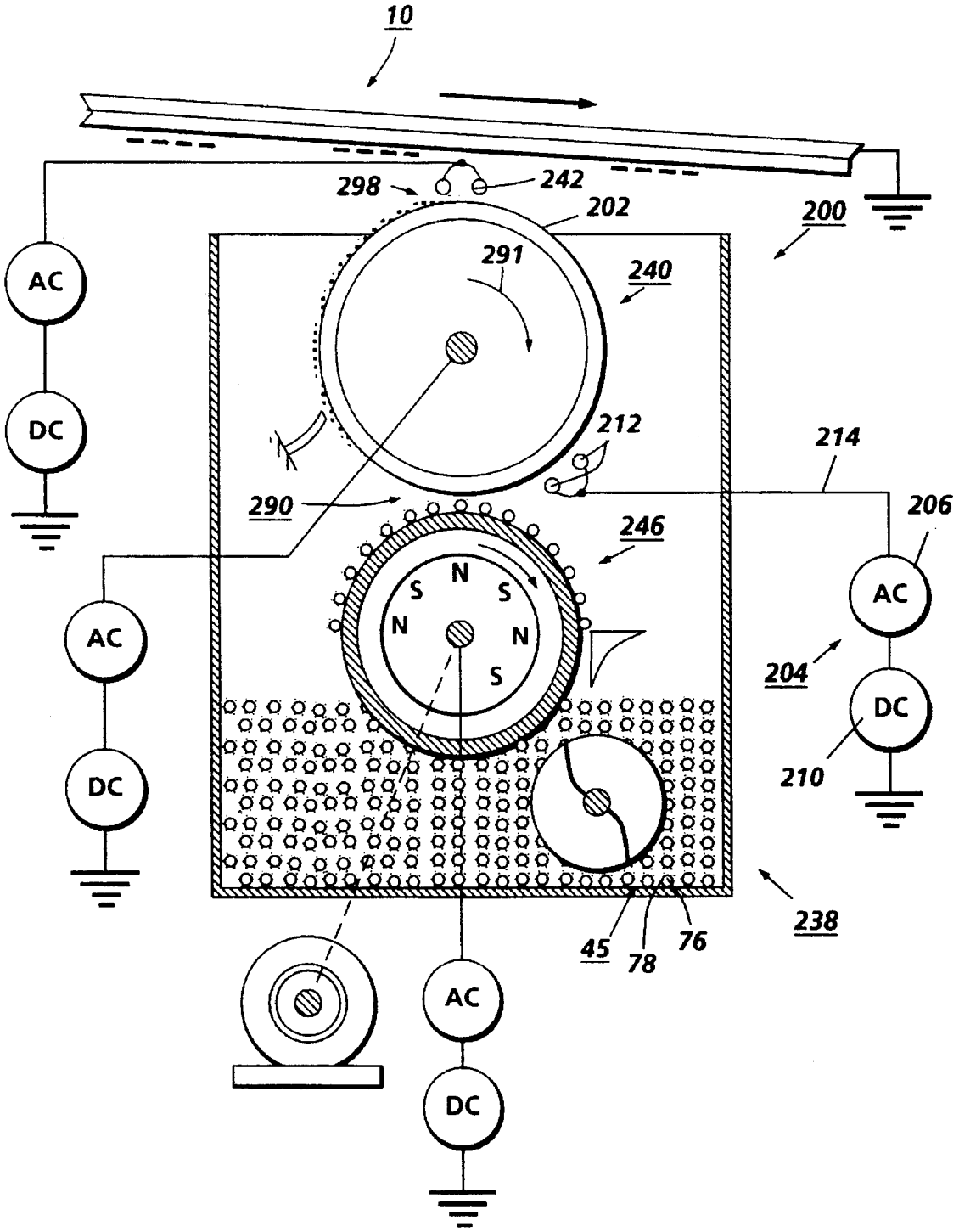
FIG. 2 is a schematic elevational view of an alternate embodiment of a development unit incorporating the load assisting toner excitation of the present invention.

Now referring to FIG. 2, toner remover 200 is shown in developer unit 238. The developer unit 238 includes a transport roll 246 which is similar to the transport roll 46 of the developer unit 38 of FIG. 1. The transport roll 246 transports developer material 45 including toner particles 78 triboelectrically adhering to carrier beads 76. The developer material 45 on the transport roll 246 progresses to loading zone 290 between the transport roll 246 and donor roll 240. Donor roll 240 is similar to donor roll 40 of the developer unit 238 of FIG. 1, except donor roll 240 does not include electrodes 40 in the periphery of the roll 240. To replace the wires 40 in the periphery of the donor roll, the donor roll 240 includes electrodes 242 in the forms of wires located in nip 298 between the donor roll 240 and the photoconductor belt 10.

The toner remover 200 is located adjacent periphery 202 of the donor roll 240 located between the developing zone 298 and the reload zone 290 in the direction of arrow 291. The toner remover includes toner remover wires 212 which are electrically connected by a conduit 214 to power source 204. Power source 204 typically includes an AC power source 206 and a DC power source 210. Toner remover 200 serves to remove the excess toner on the periphery 202 of the donor roll 240 prior to the periphery 202 of the donor roll 240 entering the reload zone 290 reloading of the donor roll 240. Similar to the toner remover 100 of the developer unit 38 of FIG. 1, the toner remover 200 serves to obtain similar levels of toner in the background and reload areas of the periphery 202 of the donor roll 240 in the reload area 290 so that the reload areas and background areas are similarly reloaded with toner. By having the reload areas and the background areas similarly reloaded, the problems with darkened and lightened reload area minimized.

The use of a charged electrode near the periphery of the donor roll between the development nip and tile reload nip improves the reload efficiency of the donor roll.

The use of a charged electrode between the development nip and the reload nip and the resulting improved efficiency of reload results in in larger quantities of toner at the development nip reducing lightened reload caused by insufficient toner.

The use of a charged electrode between the development nip increases the voltage across the toner in the reload area reducing lightened reload caused by lower voltage across the toner.

The use of a charged electrode between the development nip increases the voltage across the toner and causes the toner particle size to be smaller. The smaller toner particle size results in increased tribo and reduces darkened reload problems.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A developer unit for developing a latent image recorded on an image receiving member to form a developed image, comprising:

a housing defining a chamber for storing at least a supply of toner therein;

a moving donor member spaced from the image receiving member and adapted to transport toner from the chamber of said housing to the image receiving member in a development zone, said donor member receiving toner from a reloading zone;

an electrode structure including a plurality of electrical conductors mounted on said donor member with adjacent electrical conductors being spaced from one another; and means for establishing an electrical field between said donor member and said electrode structure spaced from the development zone and the reloading zone, to assist in cleaning toner from said donor member.

2. A developer unit according to claim 1, wherein said establishing means comprises a voltage source.

3. A developer unit according to claim 2, further comprising a commutator for commutating said voltage source into at least one of said electrical conductors, said commutator electrically connected to at least one of said electrical conductors, said one electrical conductor being spaced from the development zone when said one electrical conductor is being commutated to assist in cleaning toner from said donor member.

4. A developer unit for developing a latent image recorded on an image receiving member to form a developed image, comprising:

a housing defining a chamber for storing at least a supply of toner therein;

a moving donor member spaced from the image receiving member and adapted to transport toner from the chamber of said housing to the image receiving member in a development zone, said donor member receiving toner from a reloading zone;

an electrode structure including a plurality of wires spaced from said donor member; and means for establishing an electrical field between said donor member and said electrode structure spaced from the development zone and the reloading zone, to assist in cleaning toner from said donor member.

5. An electrophotographic printing machine of the type having a developer unit adapted to develop with marking particles an electrostatic latent image recorded on a photoconductive member, the machine comprising:

a housing defining a chamber for storing at least a supply of toner therein;

a moving donor member spaced from the image receiving member and adapted to transport toner from the chamber of said housing to the image receiving member in a development zone, said donor member receiving toner from a reloading zone;

an electrode structure including a plurality of electrical conductors mounted on said donor member with adjacent electrical conductors being spaced from one another; and means for establishing an electrical field between said donor member and said electrode structure spaced from the development zone and the reloading zone, to assist in cleaning toner from said donor member.

6. A printing machine according to claim 5, wherein said establishing means comprises a voltage source.

7. A printing machine according to claim 6, further comprising a commutator for commutating said voltage source into at least one of said electrical conductors, said commutator electrically connected to at least one of said electrical conductors, said one electrical conductor being spaced from the development zone when said one electrical conductor is being commutated to assist in cleaning toner from said donor member.

8. An electrophotographic printing machine of the type having a developer unit adapted to develop with marking particles an electrostatic latent image recorded on a photoconductive member, the machine comprising:

a housing defining a chamber for storing at least a supply of toner therein;

a moving donor member spaced from the image receiving member and adapted to transport toner from the chamber of said housing to the image receiving member in a development zone, said donor member receiving toner from a reloading zone;

an electrode structure including a plurality of wires spaced from said donor member; and means for establishing an electrical field between said donor member and said electrode structure spaced from the development zone and the reloading zone, to assist in cleaning toner from said donor member.

* * * * *